United States Patent [19]

Park et al.

[11] Patent Number: 5,030,965

[45] Date of Patent: Jul. 9, 1991

[54] SLOT ANTENNA HAVING CONTROLLABLE POLARIZATION

[75] Inventors: Pyong K. Park, Agoura Hills; Steven E. Bradshaw, West Hills, both of Calif.

[73] Assignee: Hughes Aircraft Company, Los Angeles, Calif.

[21] Appl. No.: 437,410

[22] Filed: Nov. 15, 1989

[51] Int. Cl.[5] ..... H01Q 13/10; H01Q 21/24

[52] U.S. Cl. ..... 343/770; 343/727; 343/767

[58] Field of Search ..... 343/767, 770, 771, 727, 343/768, 725, 729, 730

[56] References Cited

U.S. PATENT DOCUMENTS 2,510,290 6/1950 Masters ..... 343/767

4,853,704 8/1989 Diaz et al. ..... 343/767

FOREIGN PATENT DOCUMENTS 2142476 1/1985 United Kingdom ..... 343/767

*Primary Examiner*—Michael C. Wimer

*Attorney, Agent, or Firm*—C. D. Brown; R. M. Heald; W. K. Denson-Low

[57] ABSTRACT

An antenna incorporating a slot and a plurality of ear-like dipole elements. The antenna comprises a ground plane having a slot disposed therein, and a plurality of ear-like elements attached to one side of the ground plane along the elongated edges of the slot. The ear-like elements are oriented orthogonal to the ground plane in the same direction. Typically, the plurality of ear-like elements are disposed in a symmetrically opposed relationship along the elongated edges of the slot. The plurality of ear-like elements typically comprise two generally quadrant-shaped elements having the centers of the respective quadrant-shaped elements are disposed at or near the outer edges of the slot and the outer edge of the elements extend to about the middle of the slot. The ear-like elements may be rotated with respect to the slot in order to fine tune the polarisation direction. In a typical antenna, a plurality of slots are employed, and the present invention permits the use of randomly oriented or regularly spaced slots that are fed by means of conventional rectangular waveguides or boxed stripline. A polarized radiation field having a controlled arbitrary polarization is selectively produced by controlling the relative positions of the slot and ear-like elements.

9 Claims, 5 Drawing Sheets

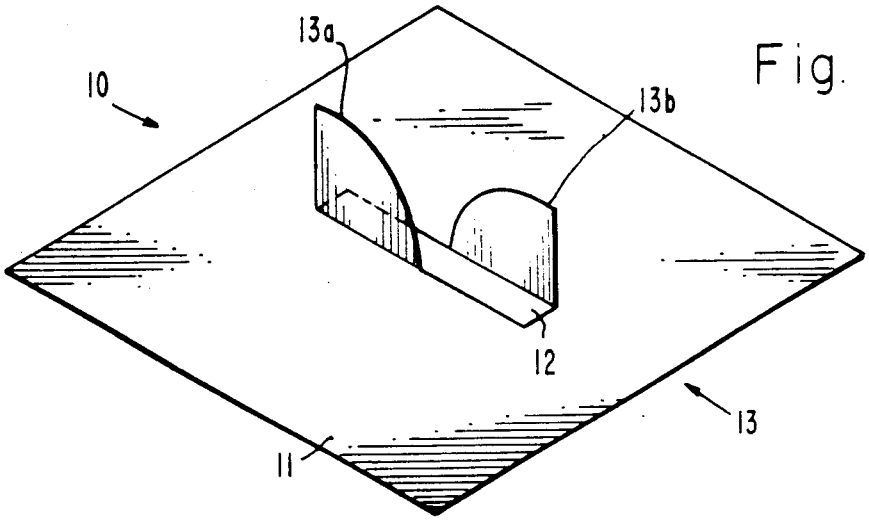
Fig. 1.
Fig. 2a.
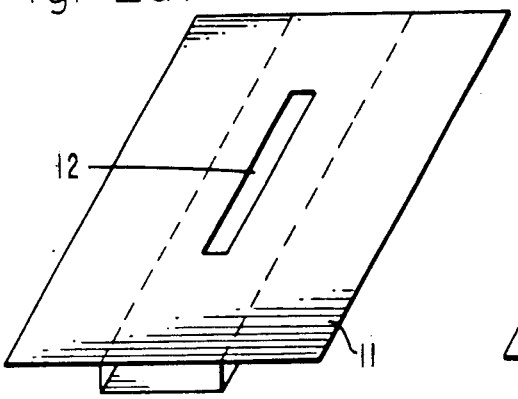
Fig. 2b.
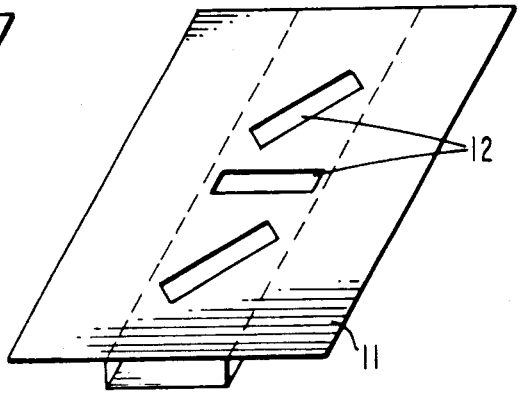
Fig. 2c.
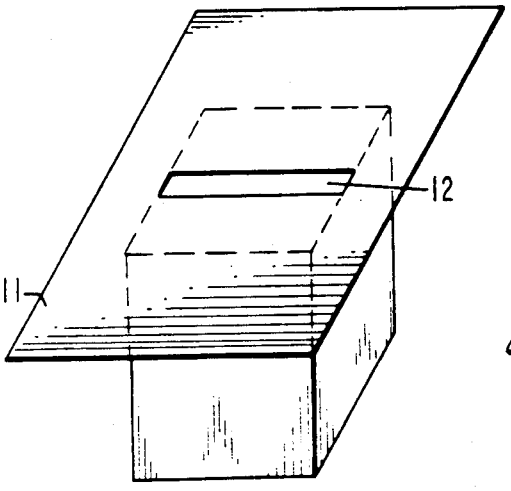
Fig. 3.
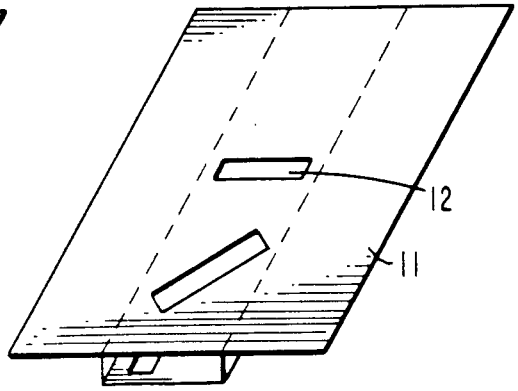

SLOT ANTENNA HAVING CONTROLLABLE POLARIZATION

BACKGROUND

The present invention relates generally to slot antennas, and more particularly to a slot antenna having controllable polarization achieved by means of ear-like members positioned adjacent the slots.

A conventional antenna can produce an arbitrarily polarized radiating field by combining two orthogonally polarized elements having the proper amplitude and phase relationship. This typically involves the use of two antennas employing a power divider and a phase shifter. Consequently, such conventional antenna designs are relatively complex, bulky and not appropriate for use in a standing wave array, for example.

Conventional slot antennas produce a radiation pattern having a polarization vector that has a direction oriented across the slots. It is desirable in many instances to be able to control the polarization direction of the energy radiated from such slot antennas in order to provide a preselected polarization state. However, heretofore, no such slot antennas have been designed.

SUMMARY OF THE INVENTION

In order to provide for a slot antenna having a controllable polarized radiating field, and which can be utilized to achieve a standing wave antenna, the present invention comprises an antenna that incorporates at least one slot and an associated plurality of ear-like elements. In particular the antenna comprises a ground plane having at least one slot disposed therein, and a plurality of ear-like radiating elements attached to one side of the ground plane. The ear-like elements are generally disposed parallel to each other and are typically disposed along the elongated edges of the slot. However, the ear-like members may be oriented at a slight angle with respect to the edges of the slot in order to fine-tune the polarization direction. Typically, no more than a 5 degree rotation is required to tune the polarization vector direction. The ear-like elements are oriented orthogonal to the ground plane in and both extend generally in the same direction. Typically, the plurality of ear-like elements are disposed in a symmetrically opposed relationship along the opposed elongated edges of the slot. More particularly, the plurality of ear-like elements comprise two generally quadrant-shaped elements having the centers of the respective quadrant-shaped elements are typically disposed adjacent the outer edges of the slot and the outer edge of the elements extend to about the middle of the slot. The ear-like elements may also have differing shapes, such as a wedge or triangular shape, for example.

In a typical antenna, a plurality of slots are employed, and the present invention permits the use of randomly oriented slots that are fed by means of conventional rectangular waveguides or boxed stripline. An arbitrarily polarized radiation field is produced by controlling the relative shapes, dimensions and positions of the slot and ear-like elements. The lengths, heights and relative amount of overlap, if any, of the two elements generally differ for each slot in a particular antenna. Typically, if all the energy radiates from the ear-like elements, then the antenna is polarized in the Y direction (along the slot). If all the energy radiates from the slot, then the antenna is polarized in the X direction (across the slot). When both the slot and ear-like elements radiate energy, then the antenna is linearly polarized if both the slot and ear-like elements radiate in phase, circularly polarized if both the slot and ear-like elements radiate with equal amplitude and the phase difference between them is ±90 degrees, and elliptically polarized if the excitation amplitude and phase associated with the slot and ear-like elements are not the same.

The antenna design of the present invention operates as an efficient standing wave array fed by a waveguide. The antenna of the present invention eliminates the added components and bulky nature of conventional antennas that achieve similar performance.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates an antenna in accordance with the principles of the present invention;

Figure 4:
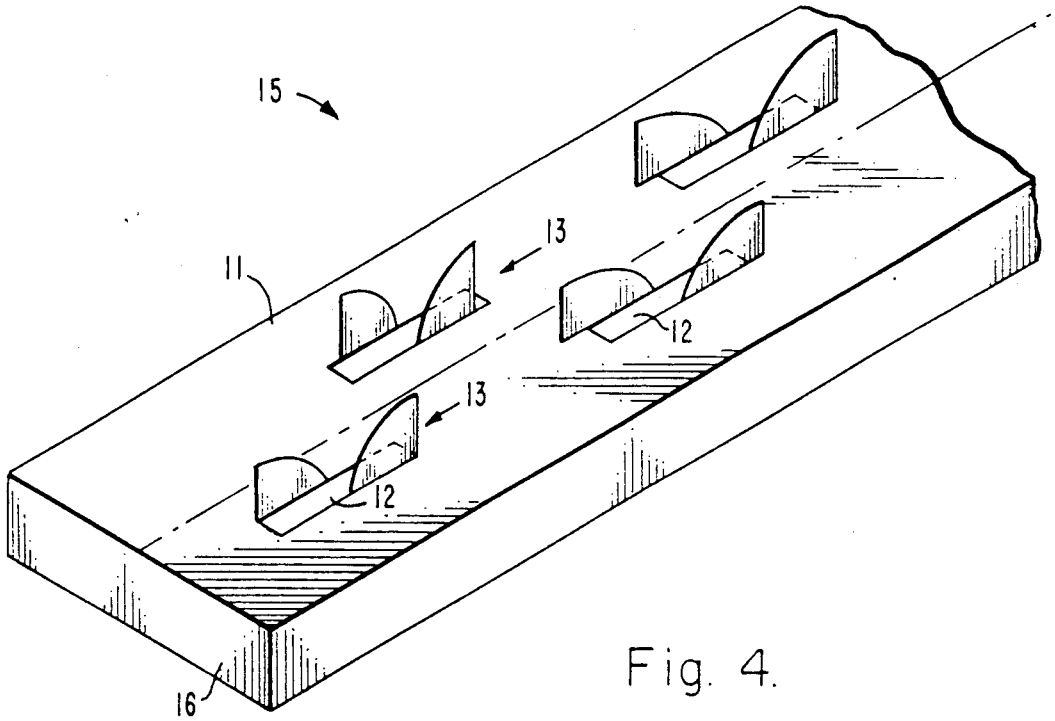
Figure 5B:
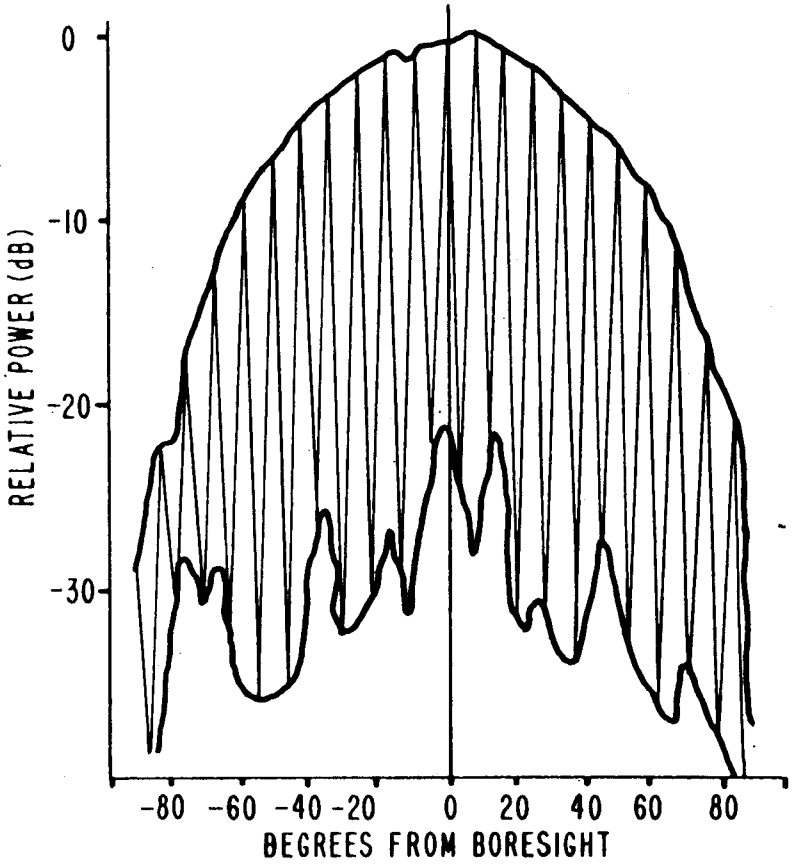
Figure 5A:
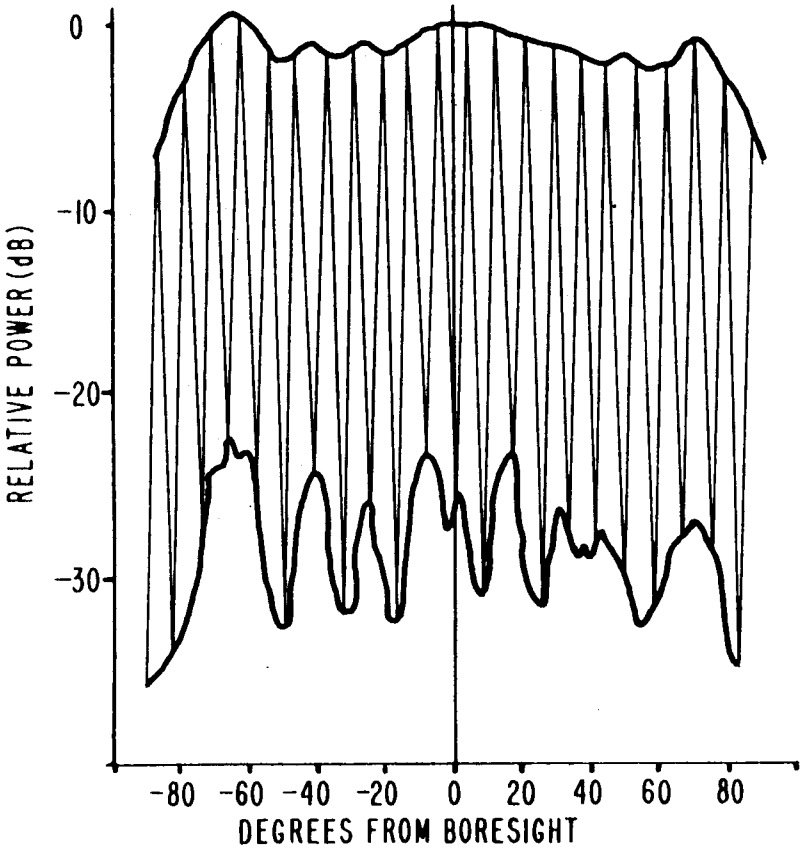
Figure 6B:
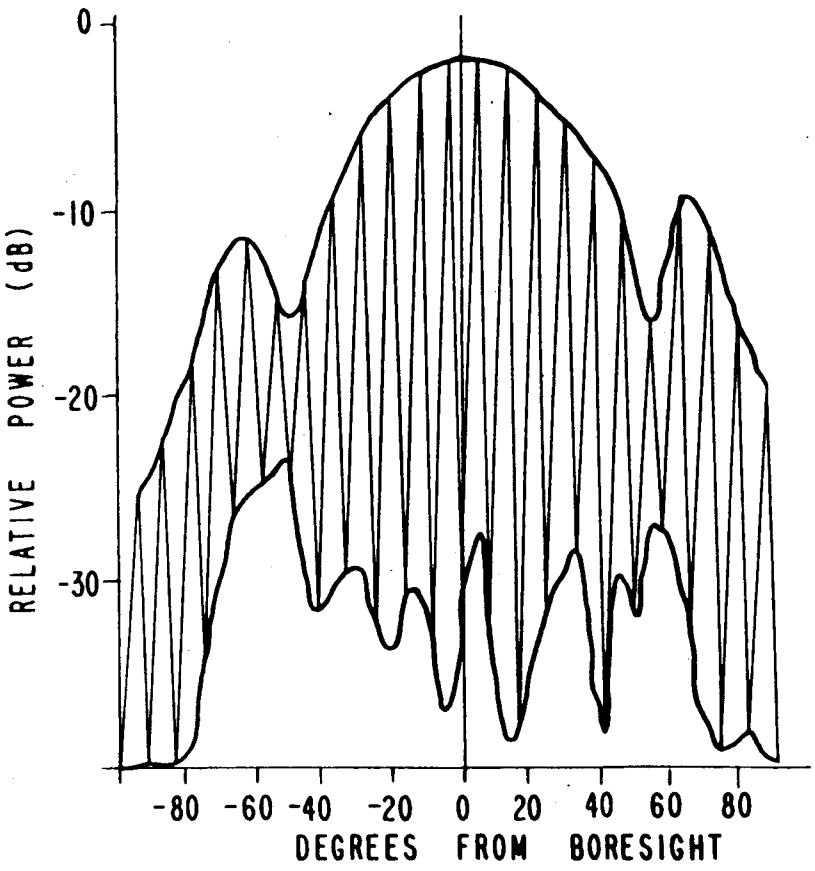
Figure 6A:
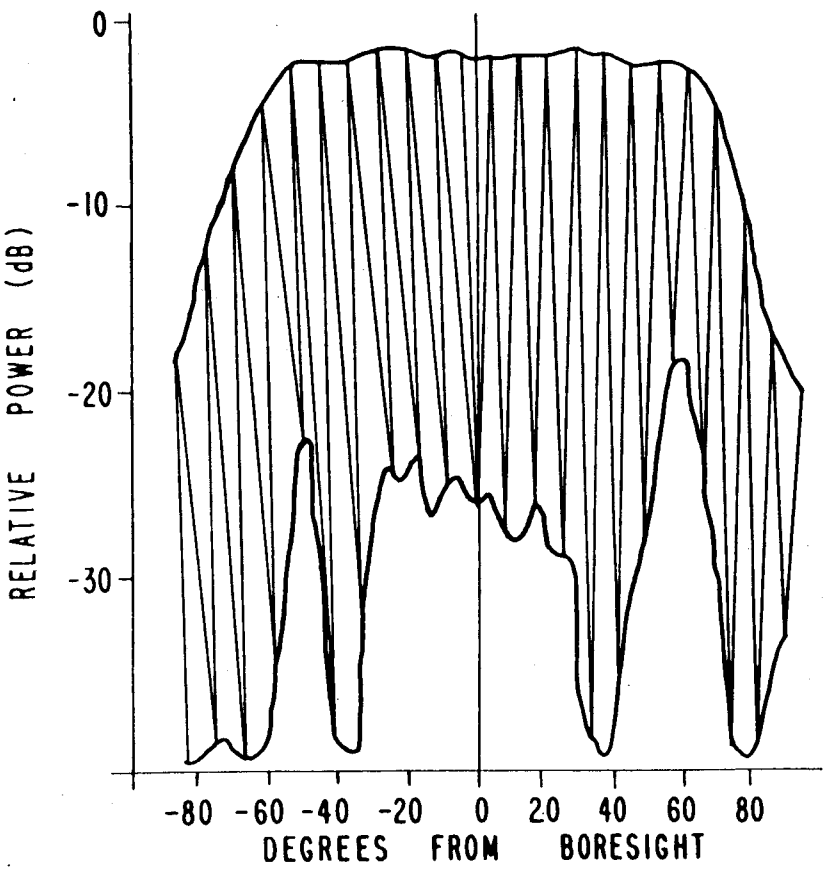
Figure 7B:
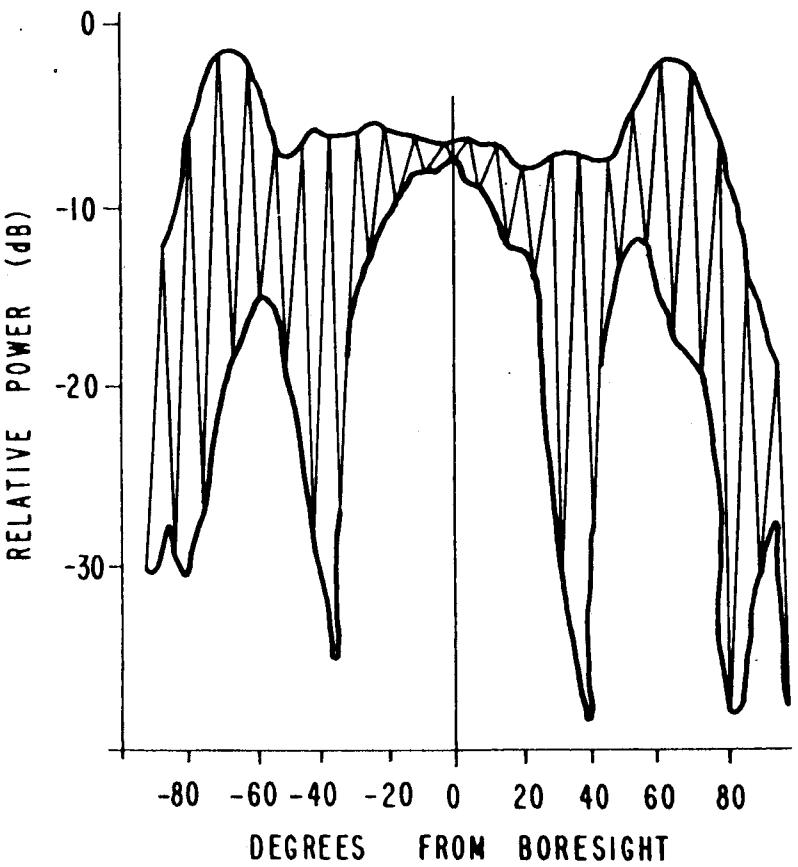
Figure 7A:
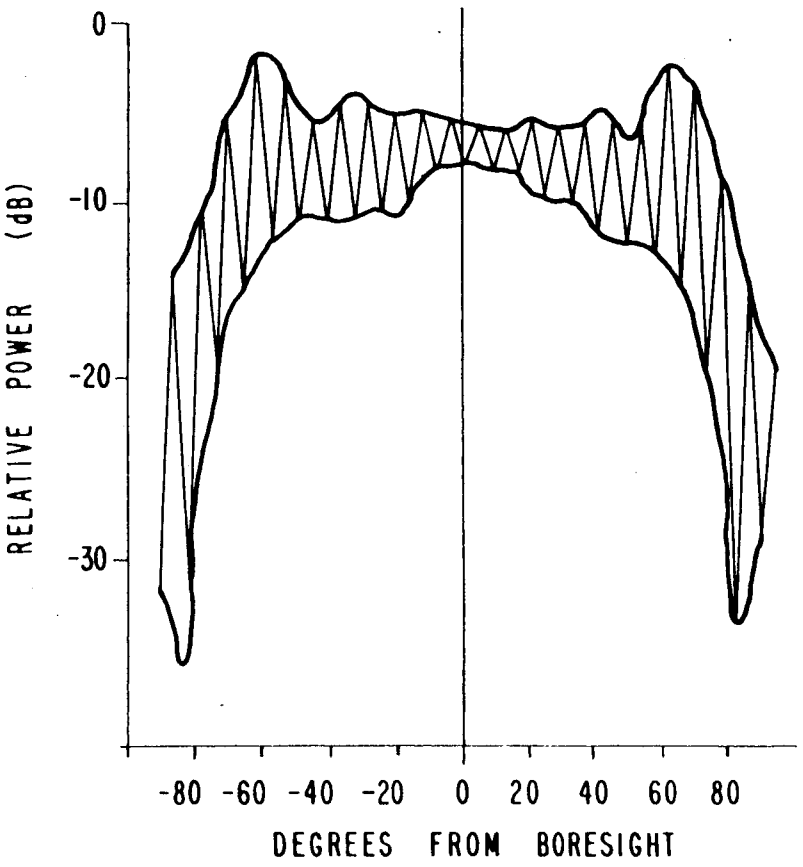

FIGS. *2a–2c* illustrate various slot antennas fed by rectangular waveguides;

FIG. 3 illustrates a slot antenna fed by boxed stripline;

FIG. 4 illustrates a waveguide fed standing wave antenna array in accordance with the principles of the present invention;

FIGS. 5*a* and 5*b* illustrate H-plane and E-plane radiation patterns for a conventional slot antenna;

FIGS. 6*a* and 6*b* illustrate H-plane and E-plane radiation patterns having linear polarization for a slot antenna in accordance with the principles of the present invention; and FIGS. 7*a* and 7*b* illustrate H-plane and E-plane radiation patterns having circular polarization for a slot antenna in accordance with the principles of the present invention.

DETAILED DESCRIPTION

Referring to FIG. 1, it illustrates an antenna 10 in accordance with the principles of the present invention. The antenna 10 comprises a ground plane 11 which has a slot 12 disposed therein. A dipole element comprising two ear-like elements 13*a*, 13*b* are conductively attached to the ground plane. The ear-like elements 13*a*, 13*b* have a quadrant-like shape and are disposed adjacent to the elongated edges of the slot 12. The ear-like elements 13*a*, 13*b* may also have other shapes such as triangular or wedge shapes, for example. The ear-like elements 13*a*, 13*b* are shown as relatively thin, flat, planar elements in FIG. 1, but other shapes and cross-sections may also be readily employed.

The ear-like elements 13*a*, 13*b* extend away from the ground plane in a generally orthogonal manner thereto, and they are positioned relative to the slot 12 such that the centers of the quadrants are generally dispose at, or near the outer edges of the slot 12 and the ear-like elements extend so that the outer edge of each of the elements 13*a*, 13*b* extend to about the middle of the slot 12. The relative size and position of the ear-like elements 13*a*, 13*b* determine the polarization of the energy radiated by the antenna 10. In addition, the relative height of the ear-like elements 13*a*, 13*b* contributes to the determination of the radiating characteristics of the antenna 10. Typically, the ground plane 11 is comprised of a metal such as copper, and the ear-like elements 13*a*, 13*b* may comprise copper foil that is conductively secured to the ground plane 11.

With reference to FIGS. 2*a*–2*c*, they illustrate various slot antennas fed by rectangular waveguides without the addition of the earlike elements 13*a*, 13*b* of the present invention. Additionally, FIG. 3 illustrates a slot antenna fed by boxed stripline. Antennas made in accordance with the principles of the present invention may employ such conventional feed mechanisms. Reference is made to the books entitled *Microwave Antenna Theory and Design*, edited by Samuel Silver, pages 291–303, Dover Publishers, Inc., and *Antenna Handbook*, edited by Y. T. Lo et al., Chapter 12, page 12–4, Van Nostrand Reinhold Co., New York, 1988, which describe such slot antennas and their design and operation.

With reference to FIG. 4, it illustrates a waveguide fed standing wave antenna array 15 in accordance with the principles of the present invention. The standing wave antenna array 15 comprises a waveguide feed arrangement 16 having a ground plane 11 in which is disposed a plurality of slots 12. Each of the slots has a ear-like elements 13*a*, 13*b* disposed adjacent thereto. The ear-like elements 13*a*, 13*b* are disposed relative to the slots generally in accordance with the teachings presented above with reference to FIG. 1. In this antenna embodiment, each of the slots 11 is disposed parallel to one another and slots are disposed along an imaginary centerline in a generally symmetrical manner in order to achieve a standing wave radiating pattern. However, other slot patterns, such as those illustrated in FIGS. 2*a*–2*c* and discussed in the cited reference books, may be employed. The standing wave antenna 16 can have any polarization depending upon the relationship between the slots 12 and the ear-like elements 13*a*, 13*b*, as has been described above.

In general, the respective sizes of the slots and the ear-like members associated with each slot are different. By appropriately adjusting the relative sizes and spacings and placement of the ear-like elements and the size of the slot, the phase of the energy radiated from a particular slot and ear-like elements can be adjusted to control the polarization direction such that any polarization direction is achievable. Individual adjustment of the ear-like elements of each slot provides for compensation for cross coupling of radiators and slots.

The antennas of the present invention may be employed as a flat plate array in collision avoidance radar, satellite antenna or seeker antenna environments. In addition, the antenna design of the present invention operates as an efficient standing wave array fed by a waveguide. This antenna of the present invention eliminates the added components and bulky nature of conventional antennas that achieve similar performance.

The antenna of the present invention disclosed with reference to FIG. 1 was tested to verify that the slot and ear-like elements could be arranged to achieve the differing radiation patterns mentioned above. In the tests, it was verified that: (1) a polarized field in the Y direction (along the slot) is achieved when nearly all the energy is radiated from the ear-like elements; (2) a linearly polarized field is achieved when both the ear-like elements and slot radiate with nearly equal amplitude and phase; (3) an elliptically polarized field was achieved when the ear-like elements and slot radiate with unequal amplitude and phase; and (4) nearly circularly polarized field is achieved when both the slot and the ear-like h elements radiate with equal amplitude and their phase difference is approximately 90 degrees.

The most general form of plane wave polarization is elliptical, with circular and linear polarization being special limiting cases. Elliptical polarization is defined by the axial ratio, or ratio of major to minor axis field strength, and by the sense of rotation of the field vector. For a practical application, it is also desirable to know the angle of the major axis relative to some reference direction. This angle is referred to as the $\beta$ angle, while the reference direction is defined to be the direction of the H-plane of the slot, namely, along the direction of the slot.

An elliptically polarized plane wave with an axial ratio of 20 dB or greater can be referred to as linearly polarized. An elliptically polarized plane wave with an axial ratio of 2 dB or less can be referred to as circularly polarized. These conventions are used with reference to the following discussion of FIGS. 5, 6 and 7.

FIGS. 5*a* and 5*b* illustrate radiation patterns of a conventional slot antenna having no ear-like members. FIG. 5*a* represents a cut plane that is the E-plane of the slot, while FIG. 5*b* represents a cut plane that is the H-plane of the slot. In this case, $\beta$ is 90 degrees, with the major axis aligned with the E-plane of the slot. This is achieved by a slot 12 having no ear-like elements 13*a*, 13*b*. The data shown in FIGS. 5*a* and 5*b* were taken by using the element as a receiving antenna scanned in the azimuthal plane, while continuously rotating the linearly polarized transmitting antenna, in a manner conventionally done in testing antenna patterns.

FIGS. 6*a* and 6*b* illustrate H-plane and E-plane radiation patterns having linear polarization for a slot antenna in accordance with the principles of the present invention. With reference to FIGS. 6*a* and 6*b*, $\beta$ is equal to 5 degrees, with the major axis aligned with the H-plane of the slot 12. This data illustrates that the radiation can be made to emanate from the ear-like members 13*a*, 13*b* and not from the slot 12.

FIGS. 7*a* and 7*b* illustrate H-plane and E-plane radiation patterns having circular polarization for a slot antenna in accordance with the principles of the present invention. This is achieved by suitable choice of dimensions for the slot 12 and ear-like element 13*a*, 13*b*. The result is that radiation emanating along the E-plane and H-plane of the slot is made equal in amplitude and of the correct relative phase to achieve circular polarization. Due to the non-planar nature of the antenna, the radiation is circularly polarized only in the area near boresight. This effect can be minimized by optimizing the antenna geometry so as to bring the phase centers of the two radiating mechanisms into close alignment.

Thus there has been disclosed a new and improved antenna that incorporates both a slot and a ear-like dipole radiator and that achieves arbitrary radiation patterns having controlled polarization depending upon the size and location of the ear-like elements relative to the slot. The antenna design of the present invention operates as an efficient standing wave array fed by a waveguide. The antenna of the present invention eliminates the added components and bulky nature of conventional antennas that achieve similar performance.

It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. An antenna comprising:

a ground plane;

a slot having elongated edges and outer edges and disposed in the ground plane; and a plurality of ear-like elements attached on one side of the ground plane along the elongated edges of the slot, and oriented orthogonal to the ground plane, the plurality of ear-like elements comprise two generally quadrant-shaped elements having the centers of the respective quadrant-shaped elements disposed at the outer edges of the slot and the outer edge of the elements rise orthogonal to the ground plane and curve back thereto at about the middle of the slot.

2. The antenna of claim 1 wherein the plurality of ear-like elements are disposed at a predetermined angle with respect to the edges of the slot.

3. An antenna comprising:

a ground plane;

a slot having elongated edges and outer edges and disposed in the ground plane; and a plurality of ear-like elements attached on one side of the ground plane along the elongated edges of the slot, and oriented orthogonal to the ground plane, the plurality of ear-like elements are disposed in a symmetrically opposed relationship along the elongated edges of the slot, the plurality of ear-like elements comprise two generally quadrant-shaped elements having the centers of the respective quadrant-shaped elements disposed at the outer edges of the slot and the outer edge of the elements rise orthogonal to the ground plane and curve back thereto at about the middle of the slot.

4. An antenna comprising:

a ground plane;

a plurality of slots having elongated edges and outer edges and disposed in the ground plane; and a plurality of ear-like elements attached on one side of the ground plane along the elongated edges of each of the slots, and oriented orthogonal to the ground plane, the plurality of ear-like elements comprise pairs of quadrant-shaped elements disposed adjacent to each slot having the centers of the respective quadrant-shaped elements disposed at the outer edges of each respective slot and the outer edge of the elements rise orthogonal to the ground plane and curve back thereto at about the middle of each respective slot.

5. The antenna of claim 4 wherein the plurality of ear-like elements are disposed at a predetermined angle with respect to the edges of the slots.

6. An antenna comprising:

a ground plane;

a plurality of slots having elongated edges and outer edges and disposed in the ground plane; and a plurality of ear-like elements attached on one side of the ground plane along the elongated edges of each of the slots, and oriented orthogonal to the ground plane, the plurality of ear-like elements are disposed in a symmetrically opposed relationship along the elongated edges of each of the slots, the plurality of ear-like elements comprise pairs of quadrant-shaped elements disposed adjacent to each slot having the centers of the respective quadrant-shaped elements disposed at the outer edges of each respective slot and the outer edge of the elements rise orthogonal to the ground plane and curve back thereto at about the middle of each respective slot.

7. An antenna comprising:

a ground plane;

a slot having elongated edges and outer edges and disposed in the ground plane; and a plurality of symmetrically disposed, parallel, ear-like elements attached on one side of the ground plane along the elongated edges of the slot, and oriented orthogonal to the ground plane, the plurality of ear-like elements comprise two generally quadrant-shaped elements having the centers of the respective quadrant-shaped elements disposed at the outer edges of the slot and the outer edge of the elements rise orthogonal to the ground plane and curve back thereto at about the middle of the slot.

8. The antenna of claim 7 wherein the plurality of ear-like elements are disposed at a predetermined angle with respect to the edges of the slot.

9. An antenna comprising:

a ground plane;

a slot having elongated edges and outer edges and disposed in the ground plane; and a plurality of symmetrically disposed, parallel, ear-like elements attached on one side of the ground plane along the elongated edges of the slot, and oriented orthogonal to the ground plane, the plurality of ear-like elements are disposed in a symmetrically opposed relationship along the elongated edges of the slot, the plurality of ear-like elements comprise two generally quadrant-shaped elements having the centers of the respective quadrant-shaped elements disposed at the outer edges of the slot and the outer edge of the elements rise orthogonal to the ground plane and curve back thereto at about the middle of the slot.

* * * * *